United States Patent [19]

Matsui et al.

[11] Patent Number: 4,928,475

[45] Date of Patent: May 29, 1990

[54] FIXED LENGTH WINDING METHOD IN A TWO-FOR-ONE TWISTER

[75] Inventors: Isamu Matsui; Masao Uehara, both of Kyoto; Shinji Noshi, Yawata; Tsukasa Kawarabashi, Kyoto, all of Japan

[73] Assignee: Murata Kikai Kabushiki Kaisha, Kyoto, Japan

[21] Appl. No.: 394,624

[22] Filed: Aug. 16, 1989

[30] Foreign Application Priority Data

Aug. 25, 1988 [JP] Japan ..... 63-210956
Feb. 24, 1989 [JP] Japan ..... 1-44364

[51] Int. Cl.[5] ..... D01H 1/38; D01H 7/86; D01H 9/14

[52] U.S. Cl. ..... 57/264; 57/58.49; 57/269; 57/281; 57/328; 242/18 PW; 242/35.5 A

[58] Field of Search ..... 57/268, 269, 270, 271, 57/281, 58.49, 58.52, 264, 328; 242/35.6 R, 18 PW, 36, 39, 35.5 A, 35.5 R

[56] References Cited

U.S. PATENT DOCUMENTS

| | | | |
|---|---|---|---|
| 3,075,715 | 1/1963 | Hensen et al. | 242/18 PW |
| 3,638,412 | 2/1972 | Rebsamen | 57/268 X |
| 3,669,373 | 6/1972 | Hori et al. | 242/18 PW X |
| 3,805,507 | 4/1974 | Steppuhn | 57/264 |
| 4,139,162 | 2/1979 | Stahlecker | 242/35.5 A |
| 4,171,779 | 10/1979 | Kamp | 242/35.5 A |
| 4,324,368 | 4/1982 | Inouye et al. | 242/18 PW |
| 4,535,944 | 8/1985 | Nakahara et al. | 57/268 X |
| 4,848,076 | 7/1989 | Ueda et al. | 57/281 |

*Primary Examiner*—Joseph J. Hail, III
*Attorney, Agent, or Firm*—Spensley Horn Jubas & Lubitz

[57] ABSTRACT

A method for winding a fixed length of yarn on a yarn-supply package in an apparatus connecting an automatic winder or an innovation spinning machine having a winder with a two-for-one twister. The method comprises dividing a single yarn-supply package transferred from a winder side to form a plurality of twist-yarn packages on the two-for-one twister side.

9 Claims, 7 Drawing Sheets

FIXED LENGTH WINDING METHOD IN A TWO-FOR-ONE TWISTER

FIELD OF THE INVENTION

The present invention relates to method and apparatus for manufacturing a yarn in which an automatic winder for rewinding a spinning bobbin or an innovation spinning machine having a winder and a two-for-one twister are connected, and a single yarn-supply package transferred from the winder side is divided on the side of the two-for-one twister into two or more twist-yarn packages.

RELATED ART STATEMENT

In the yarn-supply package produced by the automatic winder, in order to obtain yarns of higher class according to the object of use, the obtained yarn-supply package is supplied to the two-for-one twister to form a yarn having a uniform coarseness, increase a yarn strength by twisting, and introduce fluff into a yarn to provide a yarn having an extremely smooth surface. The applicant has previously proposed, in order to efficiently operate an automatic winder and a two-for-one twister, an arrangement wherein a yarn-supply package exchange device is provided between the automatic winder and the two-for-one twister in the succeeding step so that a yarn-supply package transferred along a package conveyor on the side of the automatic winder is transferred on a yarn-supply package transporting path of the two-for-one twister by the yarn-supply package exchange device to connect the automatic winder and the two-for-one twister.

FIG. 10 shows a connecting system in which an automatic winder 1 and a two-for-one twister 2 are connected through a yarn-supply package exchange device 3.

The automatic winder 1 is composed of a plurality of winding units 4. A yarn-supply package having a yarn of a predetermined length produced by each winding unit is doffed by an automatic doffing truck 5 which movable along the unit and is then delivered onto a package conveyor 6 provided along the unit.

The two-for-one twister 2 connected to the winder 1 has a plurality of spindles *7a*, *7b* arranged back to back, and a yarn-supply package transporting conveyor 8 is provided in a closed loop relation in the periphery of the machine bed. A yarn-supply package 9 and an empty bobbin 10 are transported in a mixed relation on the conveyor 8. A twist-yarn package 11 is delivered with respect to a spindle by an automatic doffing truck 17 or an operator, and an empty bobbin 10 within the spindle is exchanged with a yarn-supply package 9 on the conveyor and winding restarts.

A yarn-supply package exchange device 3 is installed between the winder 1 and the two-for-one twister 2. The empty bobbin 10 being transported on the conveyor 8 is removed from a package transporting medium (hereinafter called a tray 14), and yarn-feed packages 12*a* and 12*b* being transported from the winder side are supplied and attached thereto. Reference numeral 13 denotes an empty bobbin box, which receives empty bobbins removed from the tray 14. Referring to FIG. 10, in the two-for-one twister 2, the twist-yarn package 11 doffed by the automatic doffing truck 17 or an operator is delivered onto the conveyor belt 15 which travels between the spindles provided back to back and is received into a package receiving truck 16 sideward of the machine bed. In this embodiment, there is shown an arrangement wherein one winder 1 and one two-for-one twister 1 are connected. However, it is of course possible to connect one winder and a plurality of two-for-one twisters so as to balance an amount of production. Generally, the travel speed of yarn in the two-for-one twister is very low as compared with yarn travel speed in the winder, and for example, the yarn speed in the two-for-one twister is 30 to 70 m/min whilst the yarn speed in the winder is 1000 m/min. Accordingly, for example, the winding unit of yarn speed 1000 m/min makes a balance in production amount when spindle 133 of yarn speed 30 m/min used with respect to one winder of spindle 8.

In the connecting system of the automatic winder and the two-for-one twister mentioned in the prior art, the mechanical ability of the automatic winder is unbalanced with that of the two-for-one twister. Therefore, a number of small twist-yarn packages are intended to be obtained from a single maximum allowable yarn-supply package (for example, a yarn-supply package of 1 kg is wound by dividing it into two twist-yarn packages, each having 500 g), then a number of fixed length winding devices have to be provided on the two-for-one twister, and these devices are expensive electronic equipment, and a number of such devices are required, thus posing a problem that the cost disadvantageously increases.

OBJECTS AND SUMMARY OF THE INVENTION

It is an object of the present invention to provide method and apparatus for manufacturing a yarn in which a fixed length winding device normally provided on the side of a winder is utilized to simply divide a single yarn-supply package to form two or more twist-yarn packages.

For achieving the aforesaid object, a method for manufacturing a yarn according to the present invention comprises an arrangement wherein in winding on the winder side, a wound yarn is once dropped out of an end of yarn layer or cut every time when a fixed length of a yarn corresponding to a twist-yarn package is wound, and thereafter steady-state winding continuously takes place to obtain a single yarn-supply package, and in winding on the two-for-one twister side, doffing is effected when twisting is discontinued due to said drop-out of yarn from yarn layer or cutting of yarn to form a single yarn-supply package into two or more twist-yarn packages.

The manufacturing apparatus has an arrangement wherein on a doffing truck which is provided on the side of a winder, is movable along each winding unit and is provided with a roller, a yarn guide, a lever for removing a full package, an empty bobbin mounting arm and a cutter, are provided a full package detection sensor and a detachable stopper actuated by the full package detection sensor to release at least the empty bobbin mounting arm and the full package removing lever, and a winding diameter detector is provided on a winding portion on the side of the two-for-one twister.

A length corresponding to a twist-yarn package is measured by an automatic winder having a fixed length winding device, and drop-out of yarn from yarn layer or cutting takes place for each fixed length and lap-winding takes place, then it inevitably discontinues every length corresponding to a twist-yarn package on the side of the two-for-one twister. Doffing may be then carried out.

A detachable stopper actuated by a full package detection sensor to release at least empty bobbin mounting arm and a full package removing lever in an automatic doffing truck on the side of the automatic winder functions to render drop-out of yarn or cutting possible by utilizing a normal automatic doffing truck on the side of the automatic winder. A winding diameter detector in a winding portion on the side of the two-for-one twister discriminates a normal yarn-cut from an expected cut in a fixed length corresponding to a twist-yarn package.

BRIEF DESCRIPTION OF THE DRAWINGS

FIGS. 6*a*, 6*b* and 6*c* to 8 are respectively views showing operation of drop-out of yarn from yarn layer of a package by an automatic doffing truck.

DETAILED DESCRIPTION OF PREFERRED EMBODIMENT

Embodiments of the present invention will be described with reference to the drawings.

Figure 1:
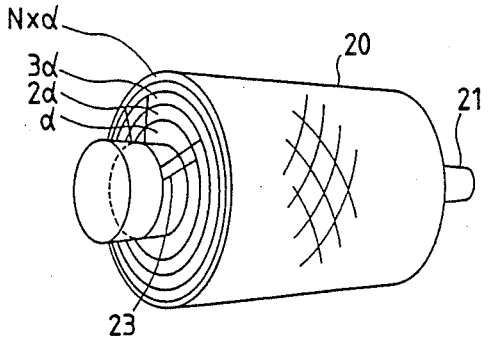
FIG. 1 is a perspective view of a yarn-supply package according to the present invention.
Figure 2:
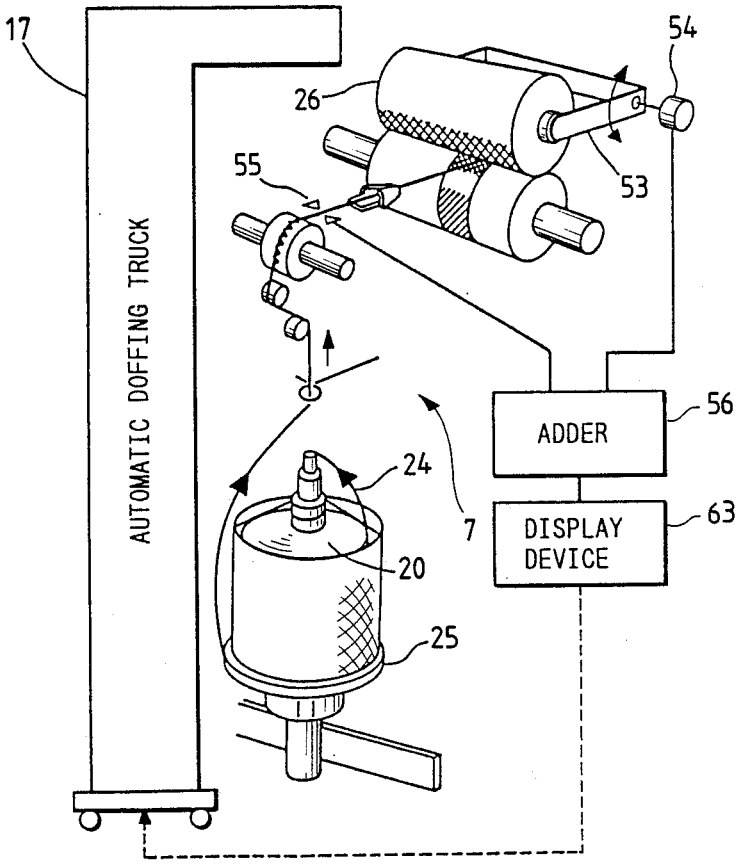
FIG. 2 is a structural view of equipment of a spindle of a two-for-one twister.

FIG. 1 is a perspective view of a yarn-feed package according to a manufacturing method of the present invention, and FIG. 2 is a view showing a method for obtaining two or more twist-yarn packages from a single yarn-supply package.

In FIG. 1, a yarn-supply package 20 is a single yarn-supply package which is divided into N every constant length $\alpha$ and wound by an automatic winder or an innovation spinning machine having a winder. As an example of division, there is shown a drop-out 23 of a yarn from a yarn layer on the end of a take-up tube 21 every length $\alpha$. The drop-out 23 is generally applied to a large diameter side of the take-up tube 21. This is because of the fact that in a spindle of a two-for-one twister, the take-up tube is set with the large diameter side placed down, and therefore, a yarn breakage resulting from the drop-out positively occurs. It is noted that in place of the breakage on drop-out yarn may be cut every length $\alpha$, and a single yarn-supply package 20 having a length $N \times \alpha$, is formed thereon.

The yarn-supply package 20 is transported to each spindle of the two-for-one twister through the conveyor and the yarn-supply package exchange device. FIG. 2 shows the state in which one yarn-supply package 20 is set one spindle 7 for twisting. Yarn 24 enters from the top of a hollow shaft of the package 20 and moves out of the side of a rotational guide 25 and is then wound while being turned. Accordingly, when the drop-out 23 is present in the package 20, that portion is broken without fail to provide a twist-yarn package 26 each having a length of $\alpha$. One which is cut in place of the drop-out comprises the twisting package 26 each having a length of $\alpha$ as it is.

Next, the manufacturing apparatus applied to carry out the present method will be described which is divided into a winding unit of an automatic winder and a spindle of a two-for-one twister. The whole structure in connection with the automatic winder 1, the two-for-one 2 and the yarn-supply package exchange device 3 therebetween is similar to those explained in connection with FIG. 10. Parts added or modified for carrying out this method will be described hereinafter.

Figure 3:
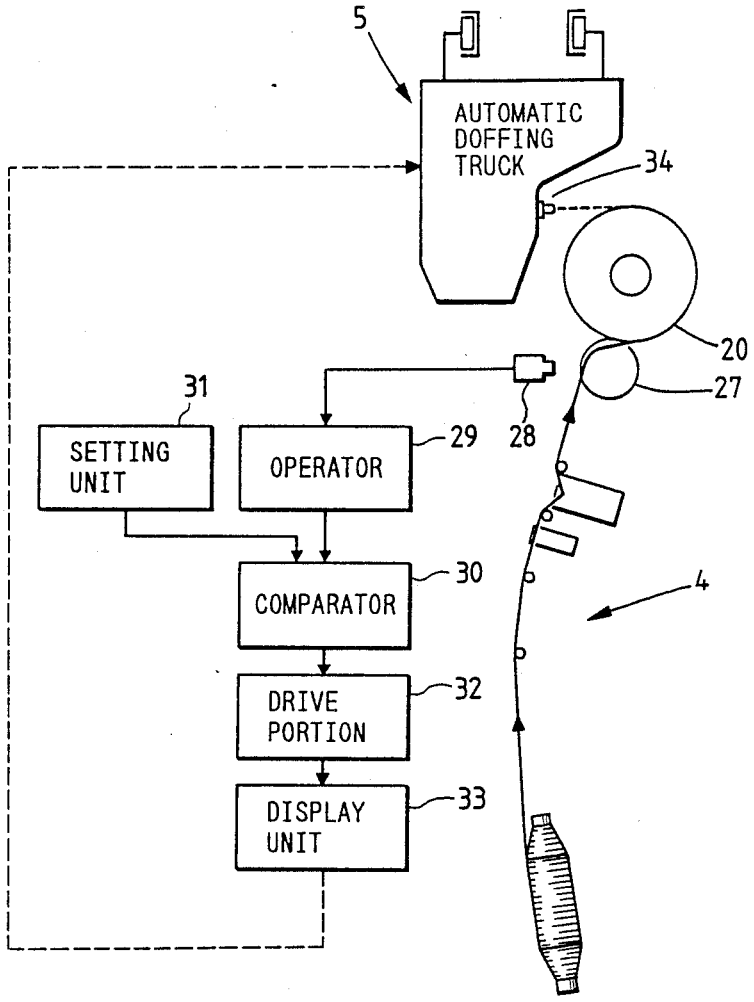
FIG. 3 is a structural view of equipment of a winding unit of an automatic winder.

FIG. 3 is a view showing a structure of equipment of a winding unit 4. In FIG. 3, a rotational frequency detector 28 is provided on a roller 27 with a spiral groove which comes into contact with a yarn-supply package 20 so as to measure a yarn speed, i.e., a winding length. A signal of the rotational frequency detector 28 is converted into a winding length by an operator 29, which is compared with a signal of a winding length setting unit 31 by a comparator 30. Output of the comparator 30 is inputted into a drive portion 32 of the roller 27 to stop winding, which is displayed on a display unit 33 such as a green lamp. An automatic doffing truck 5 is moved according to the display of the display unit 33 to assume a displayed position before the winding unit 4. Then, discrimination is made by an optical sensor 34 of the automatic doffing truck 5 whether or not the yarn-supply package 20 is full. This structure is almost similar to that of prior art except that an indication to the setting unit 31 is a length of $\alpha$ shown in FIG. 1 (in prior art, an indication corresponding to "full") and that the optical sensor 34 is added.

Figure 4:
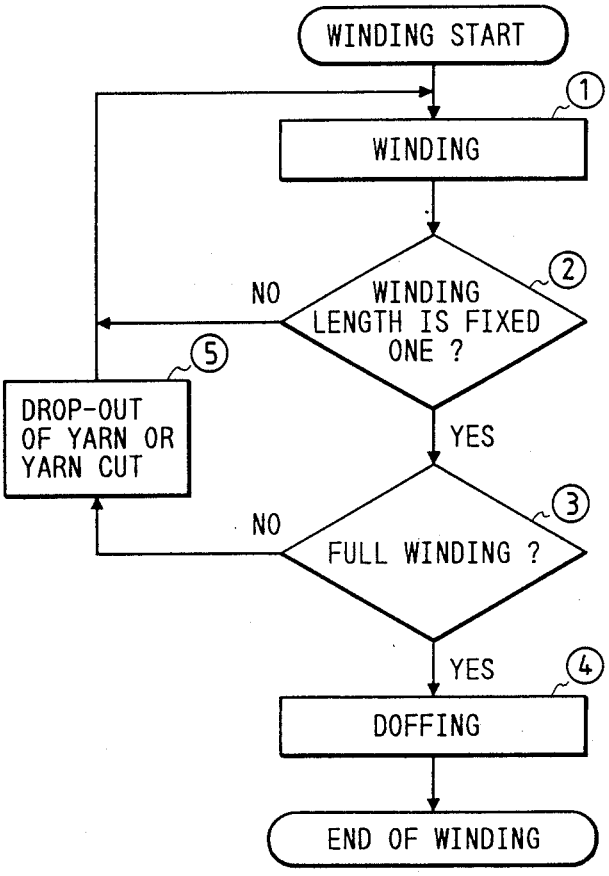
FIG. 4 is a flow chart showing operation of an automatic doffing truck of an automatic winder.

The automatic doffing truck 5 operates differently depending on the winding length which is $\alpha$ or full. FIG. 4 is a flow chart showing the operation of the automatic doffing truck 5. First, winding is started by a winding unit (Step ①). A winding length is measured to discriminate whether it is fixed length (length $\alpha$ shown in FIG. 1) or not (Step ②). If it is fixed length, discrimination is made whether it is full (length $N \times \alpha$ shown in FIG. 1) or not (Step ③). If it is full, doffing takes place (Step ④) and if not, a yarn is dropped out of a yarn layer or yarn is cut (Step ⑤). Steps ①→②→③→④→⑤ are repeated till full package is obtained to obtain a yarn-supply package shown in FIG. 1. Those different from prior art in this flow chart are that operations of drop-out or yarn cut are added in addition to the doffing.

Next, the construction and operation of the automatic doffing device 5 which is operated under the division of doffing, drop-out and yarn cut will be described with reference to FIGS. 5 to 8.

Figure 5:
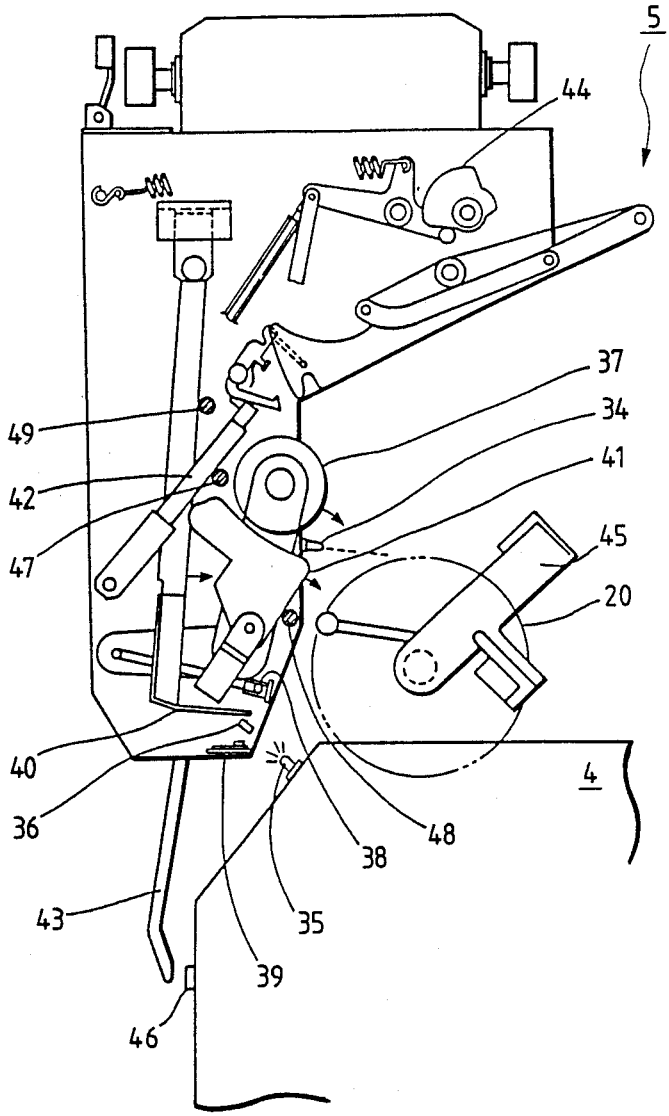
FIG. 5 is a side view of an automatic doffing truck of an automatic winder.

In FIG. 5, the automatic doffing truck 5 is provided with a sensor 36 for detecting a green lamp 35 of the winding unit 4, a roller 37, a first yarn guide 38, a second yarn guide 39, a cutter 40, a full package removing lever 41, an empty bobbin mounting arm 42, and a start lever 43, which are operated by a single cam 44. These are required for doffing operation for a full package, and operate as follows.

(1) The turn-on of the green lamp 35 is detected by the sensor 36 to move to a position before the winding unit 4 which need be operated.

(2) The roller 37 is brought into contact with the package 20 for rotation, and yarn is picked up by the first yarn guide 38 by traversing.

(3) Yarn is cut by the cutter 40.

(4) An empty bobbin is held on the empty bobbin mounting arm 42, and a cradle 45 is opened by the full package removing lever 41 to mount an empty bobbin.

(5) Yarn is pressed against the empty bobbin by the cutter 40 for holding a yarn end.

(6) The roller 37 is rotated to apply bunch winding to a large-diameter side of the empty bobbin, a take-up tube, to effect yarn-joining on the bobbin.

(7) The start lever 43 presses a botton 46 to start winding.

Among a series of operations 1 to 7 as described above, if the fourth operation is interlocked, yarn can be once cut and yarn can be wound even if a package is not full. If the third and fifth operations in addition to the fourth operation are interlocked, the drop-out of yarn can be provided without cutting yarn. Accordingly, to provide the drop-out of yarn or yarn cut, at least the operation of the full package removing lever 41 and empty bobbin mounting arm 42 may be stopped. Now, discrimination is made by the optical sensor 34 whether or not full package is present, and if not, stoppers 47 and 48 are projected to interlock the full package removing lever 41 and the empty bobbin mounting arm 42 to cut yarn. If the stopper 49 is further projected to interlock the cutter 40, the drop-out of yarn is provided.

Figure 7A:
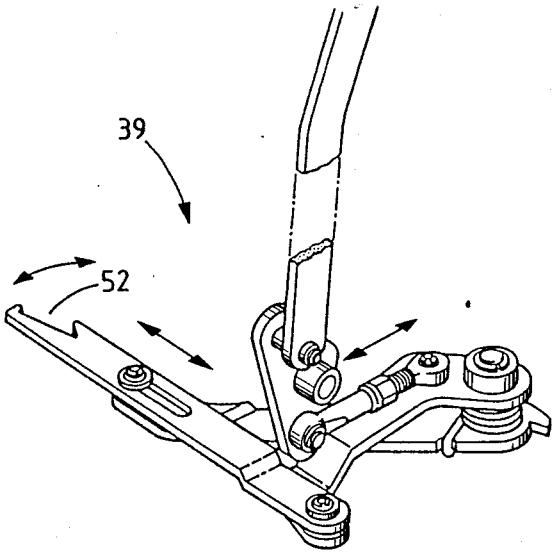
Figure 7B:
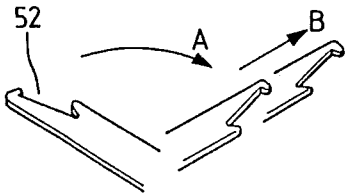
Figure 6A:
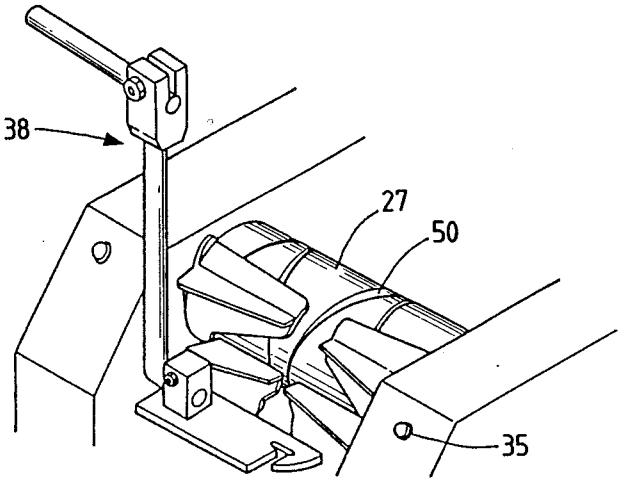
Figure 6C:
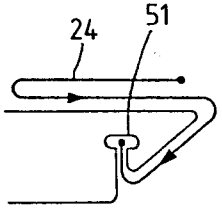
Figure 6B:
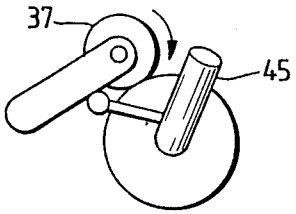
Figure 8:
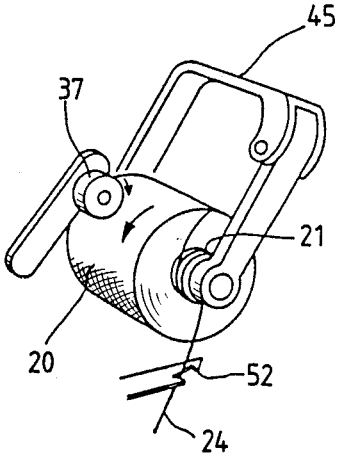

Next, the operation of the roller 37 and the first and second yarn guides 38 and 39 in the case of the drop-out of yarn from the yarn layer will be described in detail with reference to FIGS. 6*a*, 6*b* and 6*c*, FIG. 6*a* shows the case where the first yarn guide 38 is in the operating position. When the roller 37 is rotated as shown in FIG. 6*b*, yarn 24 is traversed left and right ward along the spiral groove 50 of the roller 27 to assume a position of a guide hole 51 as shown in FIG. 6*c*. FIG. 7 shows the operation of the second yarn guide 39. A guide groove 52 may be moved and rotated in an X-Y direction within a plane by a link mechanism shown in FIG. 7*a*. As shown in FIG. 7*b*, rotation in a direction of arrow A causes yarn 24 in the guide hole 51 of the first yarn guide 38 to be catched by the guide groove 52 to draw the yarn, and further movement thereof in a direction of arrow B causes the yarn to move to the end of the bobbin 21. When the roller 37 is then rotated as shown in FIG. 8, the yarn-supply package 20 rotates so that the yarn 24 is cut in end at the end of the large diameter side of the bobbin 21 and wound in the form of a bunch.

In the following, in FIG. 2, the structure of the spindle of the two-for-one twister will be described.

Twisting is discontinued by the drop-out of yarn of yarn-cut every length $\alpha$ in the yarn-supply package 20 to obtain a twisting package 26 having a predetermined length. Yarn breakage occurs due to a defect of yarn such as a weak yarn, entanglement of untwist yarn, twining at a flier and the like. If it can not be discriminated from the yarn breakage there can not obtain a twisting package 26 having a predetermined length. For this reason, a full package detector such as a rotary cam switch 54, a limit switch or the like is mounted on the cradle 53 of the twist-yarn package 26. This rotary cam switch 54 is actuated by an angle of inclination of the cradle 53, and is set somewhat before the full position of the twisting package 26. Signals of the yarn breakage detector 55 and rotary cam switch 54 normally provided are parallelly inputted into an adder 56. When the signals of the rotary cam switch 54 and yarn breakage detector 55 are simultaneously inputted, a state is judged as a full, and when only the signal of the yarn breakage detector 55 is inputted, a state of mere yarn breakage is judged. These signals are inputted into the automatic doffing truck 17 so that doffing and yarn joining are automatically carried out. There are many spindles of the two-for-one twister, and doffing and yarn joining may be carried out by hands.

Figure 9:
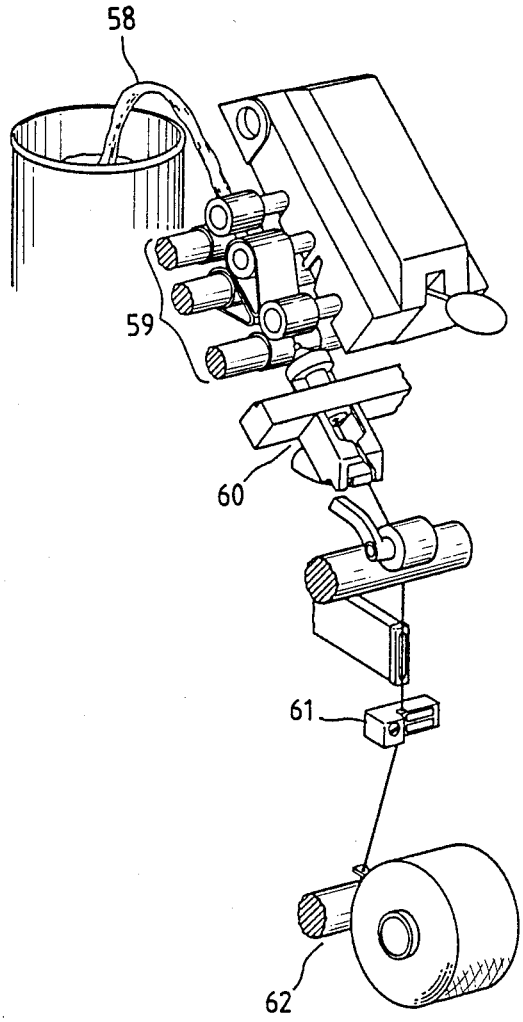
FIG. 9 is a perspective view showing essential parts of an innovation spinning machine.

While in the above description, the case of the automatic winder as the winder has been described, it is to be noted that an innovation spinning machine having a winder and a two-for-one twister may be connected by a conveyor or the like. This innovation spinning machine is shown in FIG. 9. That is, a drawing sliver 58 is directly supplied to a draft device 59 and twisted by a nozzle 60, after which a yarn defect is removed by a yarn clearer 61 and a yarn is wound by a winder 60 into a package. In this manner, the innovation spinning machine performs a series of steps, roving frame, fine spinning machine and automatic winder in a single step.

The yarn clearer 61 also serves as the fixed length winding device in the innovation spinning machine shown in FIG. 9. Yarn is being spun out of the nozzle 60 at a predetermined speed while a yarn-pressure signal is issued from the yarn clearer 61. Therefore, an actual yarn winding length is detected by use of the yarn-presence signal.

Figure 10:
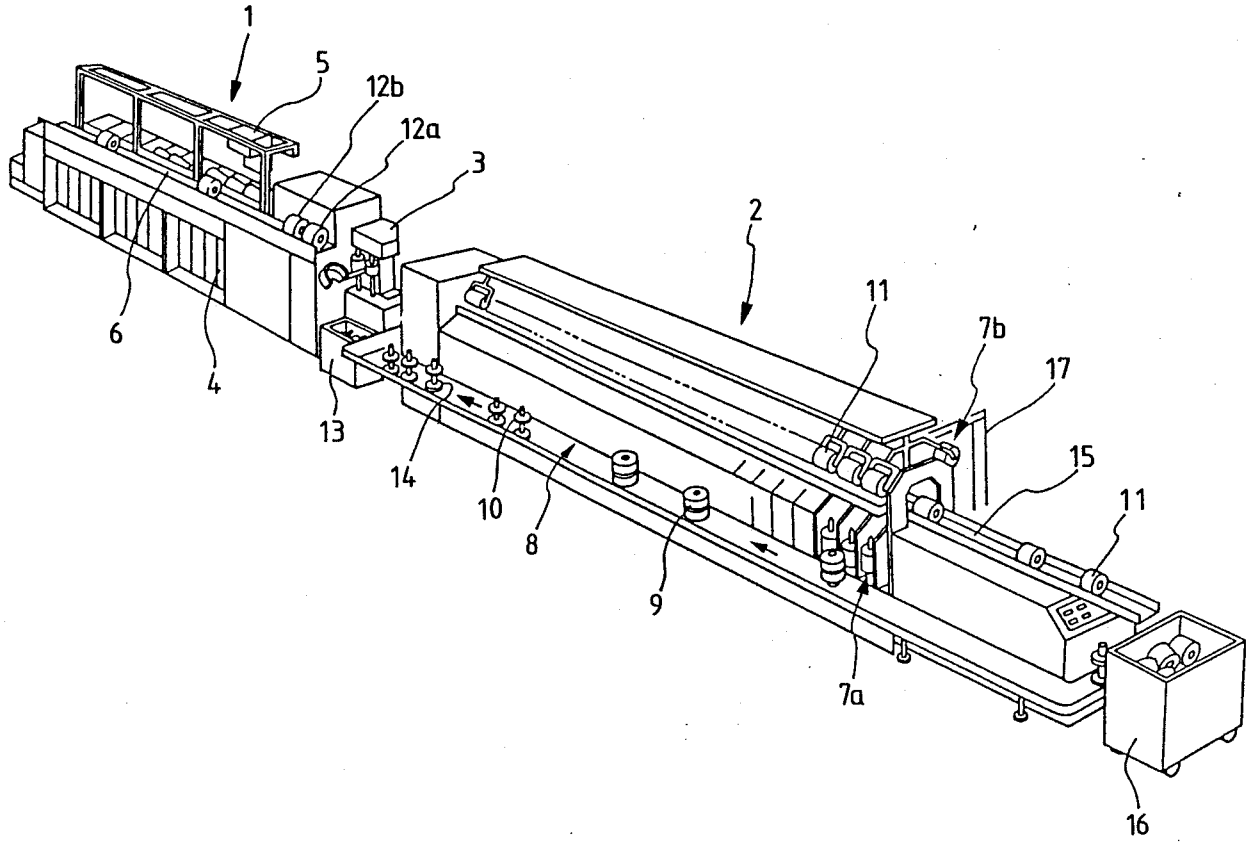
FIG. 10 is a perspective view showing a conventional connecting system of an automatic winder and a two-for-one twister.

In the system shown in FIG. 10, each spindle 7*a* of the two-for-one twister may supply packages 12*a* and 12*b* from the automatic winder in upper and lower two-stage overlapped relation. The tray 14 has the length as required, and the yarn-feed package exchange device 3 attaches onto a single tray 14 the packages 12*a* and 12*b* transported from the automatic winder one by one in two cycles.

In the system shown in FIG. 10, two yarn-supply packages can be set in an overlapped relation to each spindle 7*a* of the two-for-one twister and the packages 12*a*, 12*b* fed from the automatic winder 1 are supplied being stacked. The tray 14 is so constructed to have enough length to the two packages, and a yarn-supply package exchanging device 3 acts to put two packages 12*a*, 12*b*, which are transported from the automatic winder, on the tray 14 one by one.

In the system as shown in FIG. 10, the stacked two yarn-supply packages may be set at each spindle of the two-for-one twister and twisting can be made while adjusting untwist yarns from each package. Therefore, there is an advantage that doubling step and twisting step are simultaneously carried out.

A specific example wherein two twisting packages are obtained from a single yarn-feed package will be described hereinafter.

In the case where a maximum weight of yarn-supply packages capable being applied to the two-for-one twister is 1 kg, and the weight of the twist-yarn package 26 to be obtained is 500 g, yarn having a length corresponding to 500 g is first wound in the automatic winder to form a package, after which yarn is once cut, and 500 g of yarn is wound thereon to form the yarn-supply package 20 with 1 kg in total. When the yarn-supply package 20 is placed on the two-for-one twister to start forming the twist-yarn package 26, yarn is cut when the twisting package 20 of 500 g is formed. Therefore, winding is naturally once stopped at that time. Then, the twist-yarn package 26 having been wound by 500 g is doffed, and an empty bobbin is attached to the cradle 53 and winding restarts to thereby obtain the twist-yarn package 26 with yarn of 500 g wound thereon.

The judgement whether or not the stoppage of winding during formation of the twist-yarn package results from stoppage caused by arrival of the package 26 at fixed length or stoppage caused by some trouble is detected by an angle of inclination of the cradle 53 which increases as the package 26 forms. An angle of inclination of the cradle 53 when the package 26 reaches the desired weight is stored in advance in a controller, and when the angle of inclination coincides with a stored angle, a doffing signal is issued or a doffing device is actuated. When the angle of inclination of the cradle 53 is not coincided with a stored angle, judgement is made so that such stoppage results from trouble, and a piecing signal is issued or a piecing device is actuated.

The present invention constructed as described has the effects as described below.

According to the present method, in winding on the winder side, a wound yarn is once dropped out from a yarn layer or cut every time a fixed length of a length corresponding to a twist-yarn package is obtained, and thereafter steady-state winding continuously takes place to obtain a single yarn-supply package, and in winding on the two-for-one twister side, doffing is effected when twisting is discontinued due to said drop-out of yarn and cutting to form a single yarn-supply package into two or more twist-yarn packages. Therefore, a fixed length winding apparatus inevitably provided on the winder side can be used to simply divide one yarn-supply package to form two or more twist-yarn packages accurately wound through the desired length. That is, in other words, twist-yarn packages with a winding length each having a desired length can be obtained without provision of a substantial fixed length winding device on the side of the two-for-one twister.

Furthermore, according to the apparatus in which on a doffing truck which is provided on the side of a winder, is movable along each winding unit and is provided with a roller, a yarn guide, a lever for removing a full package, an empty bobbin mounting arm and a cutter, are provided a full package detection sensor and a detachable stopper actuated by the full package detection sensor to release at least the empty bobbin mounting arm and the full package removing lever, and a winding diameter detector is provided on a winding portion on the side of the two-for-one twister, one yarn-supply package can be divided into two or more twist-yarn packages by the simple structure comprising simple alteration of an automatic doffing truck on the winder side and mere addition of a full package detector on the side of the two-for-one twister.

What is claimed is:

1. A fixed length winding method in a two-for-one twister, the method comprising winding a yarn having a fixed length by a winder to form a package, once cutting a yarn and thereafter further winding the same amount of yarn on said package to form a maximum yarn-supply package capable of being mounted on the two-for-one twister, and mounting said yarn-supply package on said two-for-one twister to produce a plurality of twist-yarn packages having a fixed length of yarn from a single yarn-supply package.

2. A method for winding a plurality of fixed length yarn segments on a package using an automatic winder or a spinning machine having a winder, wherein said package forms the supply for a two-for-one twister, said method comprising dividing a single yarn-supply package transferred from a winder side to form a plurality of twist-yarn packages on the two-for-one twister side, characterized in that in winding on the winder side, a wound yarn is once dropped out of yarn layer or cut every time a fixed length of a length corresponding to a twist-yarn package is obtained, and thereafter steady-state winding continuously takes place to obtain a single yarn-supply package, and in winding on the two-for-one twister side, doffing is effected when twisting is discontinued due to said drop-out or cutting to form a single yarn-supply package into two or more twist-yarn packages.

3. The method as claimed in claim 2, wherein said yarn drop-out from yarn layer is done by winding a dropped yarn from the yarn layer of the package around a take-up tube of the package at an end thereof by several times, so that the wound yarn is broken at the dropped portion on twisting operation on the two-for-one twister side.

4. The method as claimed in claim 3, wherein said dropped yarn is wound around on a larger diameter portion of a tapered take-up tube.

5. The method as claimed in claim 2, wherein said doffing of a twist-yarn package on the two-for-one twister is performed by a signal of a full package detector and a signal of a yarn breakage detector.

6. An apparatus for winding fixed length of yarn in which a yarn-supply package exchange device is arranged between an automatic winder or a spinning machine having a winder and a two-for-one twister, and these are connected, characterized in that on a doffing truck which is provided on the side of a winder, is movable along each winding unit and is provided with a roller, a yarn guide, a lever for removing a full package, an empty bobbin mounting arm and a cutter, are provided a full package detection sensor and a detachable stopper actuated by the full package detection sensor to release at least the empty bobbin mounting arm and the full package removing lever, and a winding diameter detector is provided on a winding portion on the side of the two-for-one twister.

7. An apparatus for, winding fixed length of yarn in which a yarn-supply package exchange device is arranged between an automatic winder or a spinning machine having a winder and a two-for-one twister, and these are connected, characterized in that on a doffing truck which is provided on the side of a winder, is movable along each winding unit and is provided with a roller, a yarn guide, a lever for removing a full package, an empty bobbin mounting arm and a cutter, are provided a full package detection sensor, and a first and second stoppers actuated by the full package detection sensor and a winding length detecting means provided with each winding unit to stop or release at least the empty bobbin mounting arm and the full package removing lever, and a winding diameter detector is provided on a winding portion on the side of the two-for-one twister.

8. The apparatus for winding fixed length of yarn as claimed in claim 7, wherein a third stopper is further provided on the doffing truck to stop or release the cutter.

9. The apparatus for winding fixed length of yarn as claimed in claim 8, wherein said yarn guide comprises a first yarn guide having a guide hole which may hold a traversed yarn and a second yarn guide for drawing and displacing the held yarn by the first yarn guide to the end portion of a take-up tube of a package.

* * * * *